US011293119B2

(12) United States Patent
Zwieg

(10) Patent No.: US 11,293,119 B2
(45) Date of Patent: Apr. 5, 2022

(54) MUSICAL INSTRUMENT STRING AND SPORTS RACKET STRING, AND METHOD FOR PRODUCING SAID STRING

(71) Applicant: Larsen Strings A/S, Sonderborg (DK)

(72) Inventor: Thomas Zwieg, Sonderborg (DK)

(73) Assignee: Larsen Strings A/S, Sonderborg (DK)

( * ) Notice: Subject to any disclaimer, the term of this patent is extended or adjusted under 35 U.S.C. 154(b) by 0 days.

(21) Appl. No.: 16/640,018

(22) PCT Filed: Aug. 18, 2017

(86) PCT No.: PCT/EP2017/070947
§ 371 (c)(1),
(2) Date: Feb. 18, 2020

(87) PCT Pub. No.: WO2019/034263
PCT Pub. Date: Feb. 21, 2019

(65) Prior Publication Data
US 2020/0248343 A1 Aug. 6, 2020

(51) Int. Cl.

| | |
|---|---|
| ***G10D 3/10*** | (2006.01) |
| ***D02G 3/44*** | (2006.01) |
| ***A63B 51/02*** | (2015.01) |
| ***D02G 3/40*** | (2006.01) |

(52) U.S. Cl.
CPC ..... *D02G 3/444* (2013.01); *A63B 51/02* (2013.01); *D02G 3/404* (2013.01); *G10D 3/10* (2013.01); *A63B 2209/00* (2013.01)

(58) Field of Classification Search
CPC ..... D02G 3/444; D02G 3/404; D02G 3/04; G10D 3/10; A63B 51/02; A63B 2209/00
See application file for complete search history.

(56) References Cited

U.S. PATENT DOCUMENTS

| | | | | |
|---|---|---|---|---|
| 3,738,096 A * | 6/1973 | Crandall | ..... | D02G 3/444 57/242 |
| 4,168,606 A * | 9/1979 | Callander | ..... | A63B 51/02 57/236 |
| 2010/0041829 A1* | 2/2010 | Van Malderen | ..... | D01F 1/10 525/94 |

FOREIGN PATENT DOCUMENTS

| | | | | |
|---|---|---|---|---|
| WO | WO-2012065598 A2 * | 5/2012 | ..... | B29C 64/165 |

* cited by examiner

*Primary Examiner* — Kimberly R Lockett
(74) *Attorney, Agent, or Firm* — Jonathan M. D'Silva; MMI Intellectual Property

(57) ABSTRACT

Musical instrument string or sports racket string, comprising a core which comprises or is composed of a bundle of thermoplastic fibers, wherein at least some thermoplastic fibers of the bundle are at least partially, such as for example in a punctiform or linear manner, connected to one another in a materially integral manner, in particular by fusing on the boundary surfaces, and method for producing said string.

22 Claims, 8 Drawing Sheets

MUSICAL INSTRUMENT STRING AND SPORTS RACKET STRING, AND METHOD FOR PRODUCING SAID STRING

The present invention relates to a musical instrument string as well as to a sports racket string, and to a method for producing said string.

The string can also be used as a line for a fishing rod, or as a material for a trapping apparatus, in particular a fishing net.

Strings made in the traditional manner from catgut, having a core of catgut, have outstanding playing properties, in particular a high efficiency in terms of energy in the excitation and transmission of impulses, this leading inter alia to a light, rapid, and precise response. The string core from catgut is composed of a bundle of intertwined and chemically cross-linked strips of intestine, which conjointly form a strand having extraordinary strength, flexibility, and elasticity. However, strings having a core from catgut also have a raft of serious disadvantages. The latter include the high sensitivity to temperature and humidity variations, this leading to low stability in terms of stress and tuning. By virtue of the unavoidable high tolerances in terms of properties in natural products, there are furthermore great variations in the quality of products which are identical per se. Therefore, strings having a core of catgut meet the requirements of modern concert activities or sports competitions, respectively, only to a limited extent.

Alternatively, strings having a core from polymer fibers are known, for example from polyamide in U.S. Pat. No. 2,226,529, or from PEEK in GB 2303730 A. The string core for strings of the bowed string instruments, such as described for example in AT 169306, AT 309188 or EP 2 099 022 A1, is usually produced from fiber bundles or multifilament yarns, respectively. As set forth in AT 169306, AT 309188 or EP 209 2 022, a predefined number of multifilament yarns for the core are bundled and in a manner comparable to that of catgut typically twisted when producing the string core. However, no chemical cross-linking takes place herein, that is to say the filaments are always capable of being separated without any substantial destruction. On account of the predefinable plurality of synthetic polymer fibers and the twisting of the latter, the internal attenuation and thus the sound of the string can be influenced, this rendering said strings particularly suitable for bowed instruments' strings.

This loose composite of the plastics-material fibers in the string core under loading and oscillation of the string however leads to a mutual relative movement of the fibers, this leading to internal friction and thus losses in terms of energy. The relative movement of the fibers under loading furthermore causes mechanical wear on the fiber surfaces, on account of which the service life of the string, in particular in acoustic terms, is decreased on account of the change in acoustic coupling and attenuation. Substantial disadvantages of said strings in comparison to strings from catgut are therefore higher losses in terms of energy in the excitation and transmission of impulses, a poorer response, or a slower reaction in excitation, and a shorter service life.

Alternatively, strings having a core from a steel cable are known from, for example, U.S. Pat. No. 2,641,949 and EP 2 131 352 A1. Said strings have an extraordinarily high stability in terms of loading and tuning, respectively. Strings having such a core display the same mutual relative movement of the individual wires, this again leading to internal friction and thus losses in terms of energy. In order for this problem be solved, musical strings having a core from fine steel wires, carbon and/or silicon carbide fibers are known, wherein the wires of the core here are embedded in an elastomer or a ductile metal. In musical strings of this type it is disadvantageous that said musical strings in comparison to strings having a core from catgut or polymer fibers can be excited only while applying a comparatively high bow pressure and are therefore suitable only to a limited extent for performing music with differentiations in terms of dynamics and/or timbre. Musical strings of this type moreover have the disadvantage that said musical strings react poorly to alternating bow strokes such that said musical strings are considered to be slow and decelerating by the musician, and it is possible only to a limited extent to cleanly intonate and play fast movements or alternating bow strokes in the spiccato routine when using such musical strings.

U.S. Pat. No. 5,601,762 describes strings for musical instruments, sports equipment, or fishing activities, which have a composite core from a plurality of polymer threads which are connected by a bonding resin. According to the example from FIG. 2 of the U.S. Pat. No. 5,601,762, the string formed in such a manner is encased with a further resin. As a further treatment of the strings, U.S. Pat. No. 5,601,762 proposes that a treatment using radioactive radiation is performed.

U.S. Pat. No. 4,016,714 describes strings for sports rackets and musical instruments, which have a composite core from a plurality of thermoplastic filaments which are twisted together and are connected by a first cationic wetting agent and finally with a thermoplastic bonding resin.

A string having a core from a thermoplastic material is known from JPH 07150434, said core being sheathed with many thin threads from vinyl fluoride which in turn appeared to be sheathed with a resin. JPH 03205070 A in turn describes a string having a composite cable core which is stranded from individual composite elements. Each of the composite elements is composed of aramid fibers which have been fused with nylon fibers. The composite elements are then twisted and wrap-spun with further aramid and nylon fibers which are embedded in a nylon resin, said nylon resin forming the surface of the string.

A musical string having at least one composite core in which the at least one composite core comprises a first core element and a second core element, wherein the first core element and the second court element comprise at least one organic material, and wherein the first core element and the second core element are at least in regions connected by means of an intervening and/or core-elements-sheathing polymer element is known from AT 504 015 B1, or U.S. Pat. No. 8,283,538 B2, characterized in that the first polymer element is substantially tension-free in the case of a musical string that is tensioned at a predefined tuning weight. The string elements in all embodiments described are constructed from dissimilar materials. The actual core material here differs from a connecting polymer.

A common disadvantage of all these proposed solutions is a comparatively high attenuation of energy, or acoustic attenuation of the string constructions, respectively, on account of the many materials, especially polymers and binding agents, that are combined with one another. The numerous phase transitions from one material to the other which are to be found in all proposed solutions set forth, lead in particular to high losses in terms of energy of the applied impulse, and thus to a poorer response in terms of playing technique and acoustics.

The present invention is thus based on the object of providing a musical instrument string or sports rackets string, respectively, having high stability and consistency in terms of strength, elasticity, and flexibility, said string being distinguished in particular by low losses in terms of energy in the excitation and transmission of impulses as well as by an increased service life.

Said object is achieved according to the invention by a musical instrument string or sports rackets string comprising a string core which comprises or is composed of a bundle of thermoplastic fibers, wherein at least some thermoplastic fibers of the bundle are at least partially, such as for example in a punctiform or linear manner, connected to one another in a materially integral manner, in particular by fusing on the boundary surfaces. A materially integral connection is in particular be understood to be a connection of the thermoplastic fibers which cannot be released without damage or even destruction. It is to be noted that the term "string core" here is also used when the string core, or the string, respectively, does not have any sheathing.

Said object is furthermore achieved by a method for producing a string as claimed in one of claims 1 to 14, wherein at least some thermoplastic fibers of the bundle or of each bundle are at least partially, such as for example in a punctiform or linear manner, connected to one another in a materially integral manner, in particular by fusing on the boundary surfaces.

The bundle of thermoplastic fibers advantageously forms an inherently bonded flexible strand.

In one particular embodiment, the string core can comprise a plurality of said bundles of thermoplastic fibers, wherein the bundles of thermoplastic fibers form a plurality of in each case inherently bonded flexible strands.

The thermoplastic fibers are advantageously highly oriented. This manifests itself in that the macromolecules of the fibers display an orientation and alignment along the fiber axis. Said macromolecules, besides the amorphous phase, also contain crystalline regions. The fibers are at least partially crystalline.

The elongation of the thermoplastic fibers at room temperature and at maximum tensile loading is advantageously less than 20%, and the elongation at break of the thermoplastic fibers is less than 25%.

The thermoplastic fibers of the bundle or of at least one of the bundles are expediently twisted in single-ply or two-ply form.

In one particular embodiment, at least part of the thermoplastic fibers has a core/casing structure.

It can in particular be provided herein that the fiber core of the core/casing structure comprises or is composed of a first thermoplastic material, and the fiber casing of the core/casing structure comprises a second thermoplastic material.

It can in particular be provided herein that the volumetric proportion of the fiber casing of the core/casing structure is less than 60% by volume, preferably less than 30% by volume, and particularly preferably less than 20% by volume.

The fiber casing particularly preferably additionally contains ferromagnetic and/or ferrimagnetic particles, in particular solid matter particles.

The particles advantageously have a primary particle diameter which is less than 500 nm.

In one particular embodiment, the first thermoplastic material and the second thermoplastic material are identical. However, the first thermoplastic material and the second thermoplastic material can also be dissimilar.

The thermoplastic fibers expediently comprise or are composed of polyaryletherketone (PAEK), preferably polyetheretherketone (PEEK), and/or polyamide (PA), and/or polyimide (PI), and/or polyphenylene sulfide (PPS), and/or polyvinylidene fluoride (PVDF).

The string advantageously has at least one sheathing, preferably from at least one plastics material or at least one metal, said sheathing preferably being disposed or wound helically about the string core.

In the method, it can be provided that said method comprises the continuous or batch-wise feeding of a bundle of thermoplastic fibers while simultaneously heating said bundle of thermoplastic fibers continuously or in batches when running through or along a magnetic induction installation.

It can in particular be provided herein that when heating the thermoplastic fibers having the core/casing structure at least the fiber casing is heated and at least slightly fused on account of the inductive heating.

It can in particular also be provided that thermoplastic fibers without a fiber casing by heating the fiber casings of surrounding thermoplastic fibers having the core/casing structure are likewise at least partially slightly fused on the surface and fused and connected in a materially integral manner to the latter in the contact faces.

The tension of the thermoplastic fibers is preferably set when the latter run through or along the induction heating installation. In the case of strings that are cut to length, this can take place, for example, by way of a mechanical tensioning weight, by spring force, or a mechanic resistance by rollers at one or both string ends, or by tensioning hooks, respectively, which hold the string and taughten or stretch, respectively, the fiber bundle to the desired extent. In the case of continuous fibers, this can take place, for example, by way of dissimilar speeds of the godets/rollers transporting the fibers, as well as by way of mass-loaded or spring-loaded tension rollers.

The thermoplastic fibers are expediently conjointly twisted prior to fusing.

According to one further particular embodiment of the present invention, the string core is formed from a plurality of said bundles, preferably in a twisted form, that form in each case one strand.

It can moreover be provided that the surface of the string core is sanded/and/or polish by machining.

According to one further particular embodiment of the present invention, the string core is provided with a first sheathing which is preferably helically wound about the string core and preferably is from a preferably round or flat wire, or from a polymer monofilament.

It can finally be provided that the string core is provided with at least one further sheathing which is preferably helically wound so as to be parallel or crossed about the first sheathing and preferably is from an in particular round or flat wire, or from a polymer monofilament.

The present invention is based on the surprising insight that a loss in terms of energy in the string core on account of the friction of loosely connected individual fibers when loading and moving the string is reduced or even suppressed on account of the novel, direct and materially-integral connection of the thermoplastic fibers of the string core, and the strength, elasticity, and flexibility of the string core herein are simultaneously even improved. Furthermore, binding agents, resins, or intermediate polymers which are used in the prior art are dispensed with, on account of which numerous phase transitions from one material to another material which lead to high losses in terms of energy of the applied impulse and thus to a poorer response in terms of playing technique and acoustics are avoided.

Strings having such a novel string core display extraordinarily high stability and consistency in terms of strength, elasticity, and flexibility. The strings have in particular a high stability in terms of loading or tuning, respectively, a particular light and rapid response even at rapidly alternating bow strokes and in the spiccato routine, even at the slightest bow pressure.

In a string, in particular for bowed-string instruments and/or plucked instruments, or else sports equipment, comprising a core (string core) and optionally at least one first sheathing which is disposed about the string core, it is proposed at least in one particular embodiment in order to achieve stability in terms of loading or tuning, respectively, rapid response and, in the case of musical strings a clean singing sound, that the core comprises a predefinable multiplicity of multi-component thermoplastic fibers which by forming local fusing zones in the boundary surface region of the thermoplastic fibers are connected to one another in an at least partially materially integral manner and thus are incapable of being mutually separated without destruction.

A string which has a particularly light, rapid and precise response, comparable to that of strings having catgut, however without the particularly disadvantageous sensitivity of said catgut strings in relation to humidity and temperature variations, can be implemented.

At least in one particular embodiment, the musical instrument string has a clean, colorful and singing sound already at slightest excitation. Said musical instrument string, in conjunction with a large dynamic spectrum, widens the artistic potential for expression of a musician.

On account of the minor tuning tension which is possible on account of the construction, the musical instrument strings are also recommended for baroque or mediaeval, respectively, string instruments. In particular, strings produced using the novel string core can also be used without further wrap-spinning, that is to say with a bare core, specifically as musical instrument strings and also as sports racket strings, since the core at least in one particular embodiment forms a firm inherently bonded strand. In the case of the musical instrument strings, strings having this novel core in a bare embodiment are recommended, for example, for use as a violin E and A string, or as a viola A and D string, said strings historically likewise not having being used as wrap-spun intestine string. In the context of a completed musical instrument string, said strings still lack the surface optimization including, for example, longitudinal sanding, the color coding at the ends, and the suspension, for example the ball. The string core can also be formed from more than one of the individual strands bonded in a materially integral manner, for example from three, five, or more such strands. The strands herein can be conjointly twisted in a predefined number. For example, said multistrand string core can be used having the loosely twisted strands, or additionally be locally heated once again in a magnetic field and thus be designed so as to be even more compact.

Further features and advantages of the invention are derived from the appended claims and from the description hereunder in which a plurality of exemplary embodiments of the invention are explained by means of the schematic drawings in which:

Figure 7:
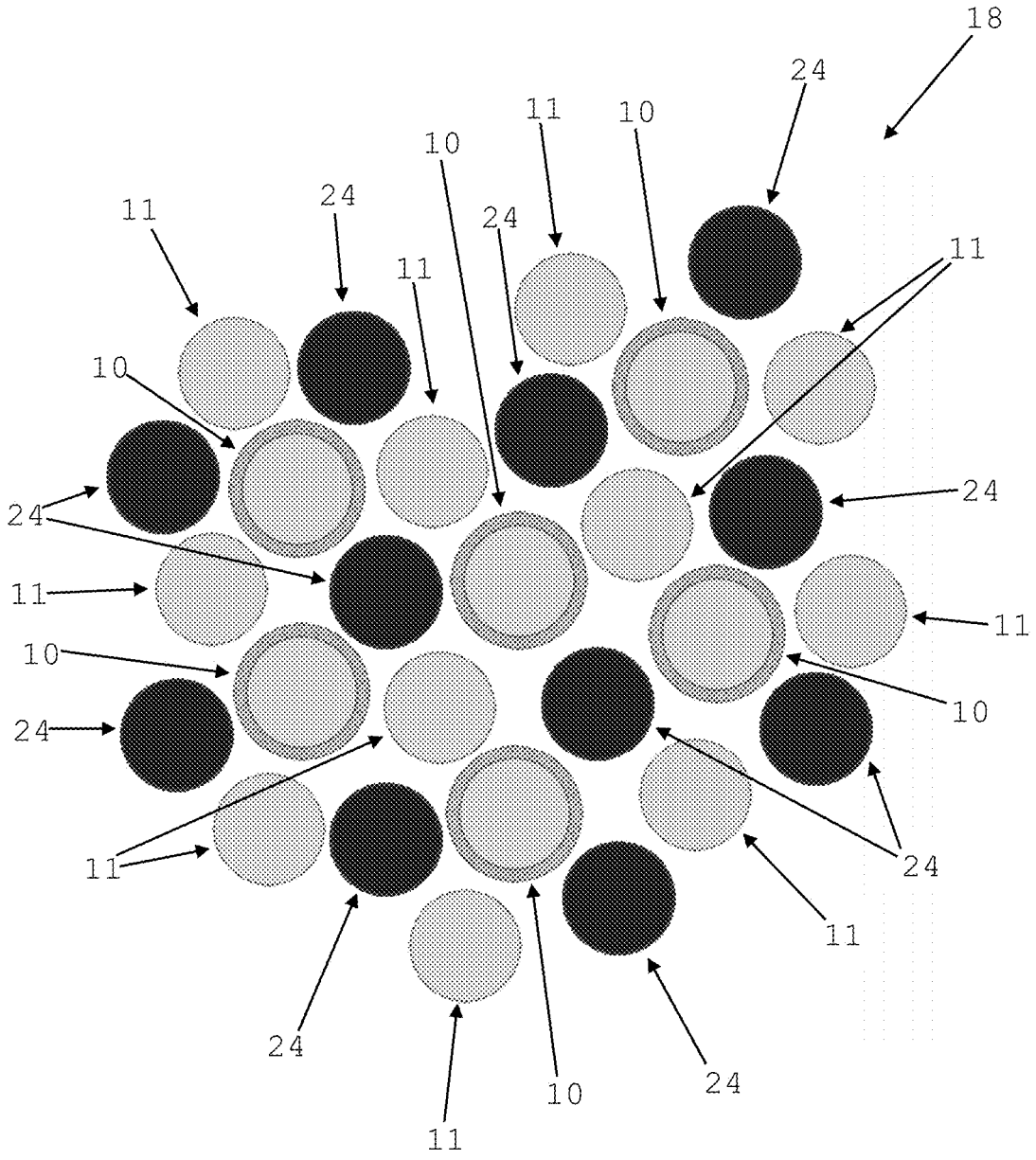
Figure 8:
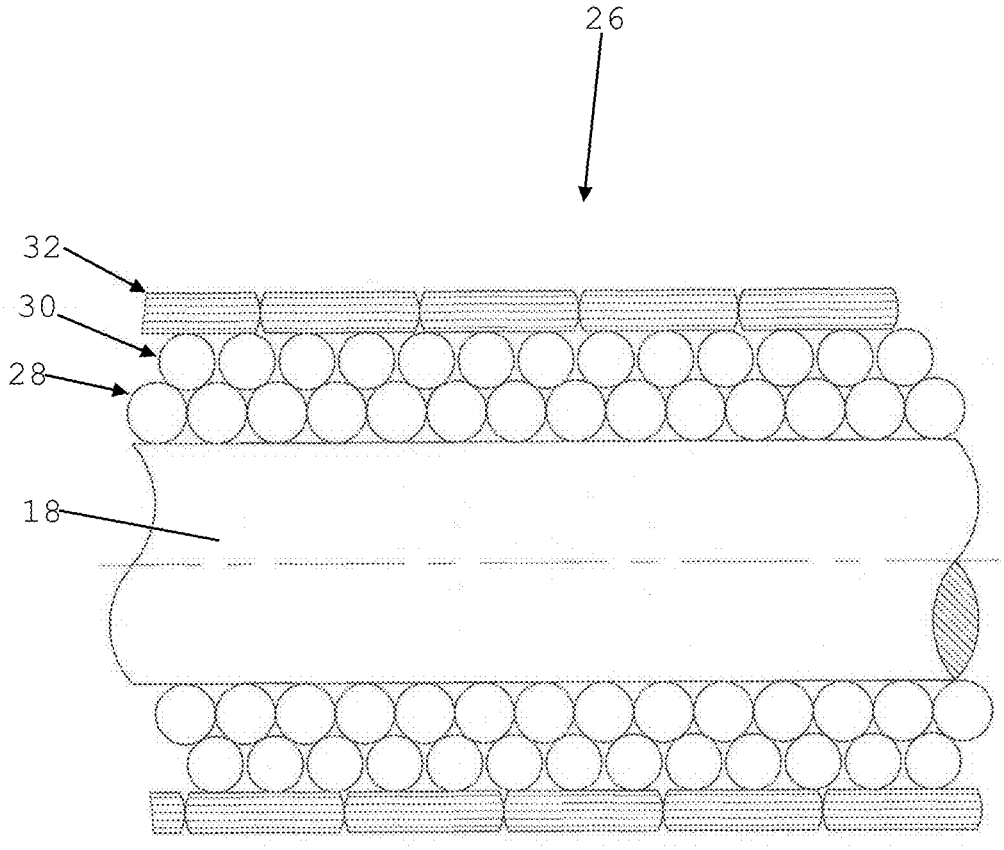

FIG. 7 shows a cross-sectional view of a string core from a plurality of thermoplastic fibers with and without a core/casing structure and fibers, composed of one further material, one string (musical instrument string or sports racket string) according to one further particular embodiment of the present invention in a preliminary product stage; and FIG. 8 shows a partial longitudinal sectional view of a musical instrument string according to one particular embodiment of the present invention.

Figure 1:
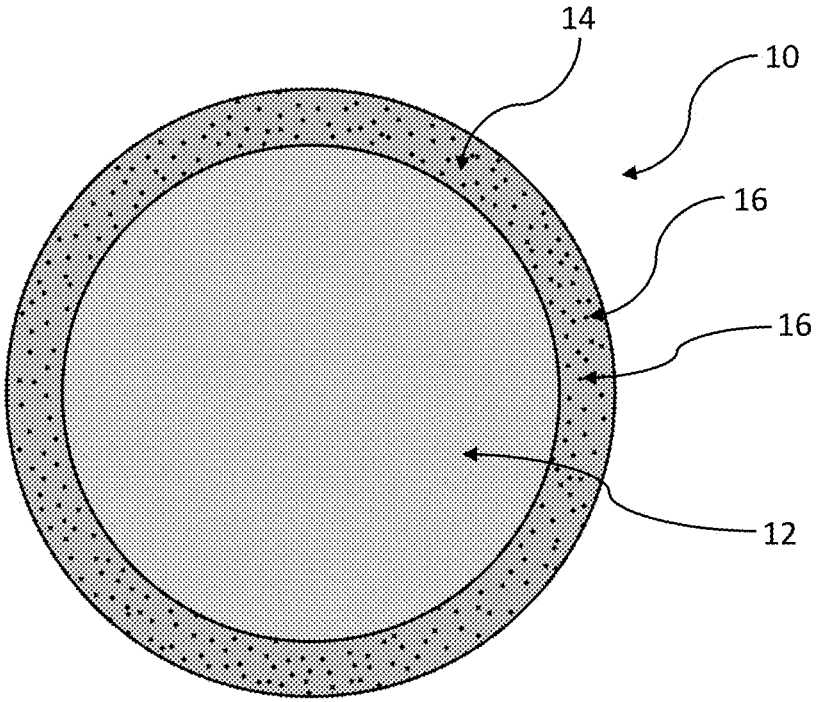
FIG. 1 shows a cross-sectional view of an individual thermoplastic fiber having a core/casing structure of the string core of a string (musical instrument string or sports racket string) according to one particular embodiment of the present invention.

The thermoplastic fiber 10 illustrated in FIG. 1 in this example has a circular cross section and a core/casing structure, wherein the fiber core 12 is composed of a first thermoplastic material, and the fiber casing 14 is composed of a second thermoplastic material and ferromagnetic particles incorporated therein, only some of said ferromagnetic particles being identified by the reference sign 16. The ferromagnetic particles in this example are uniformly distributed exclusively in the fiber casing.

Figure 2:
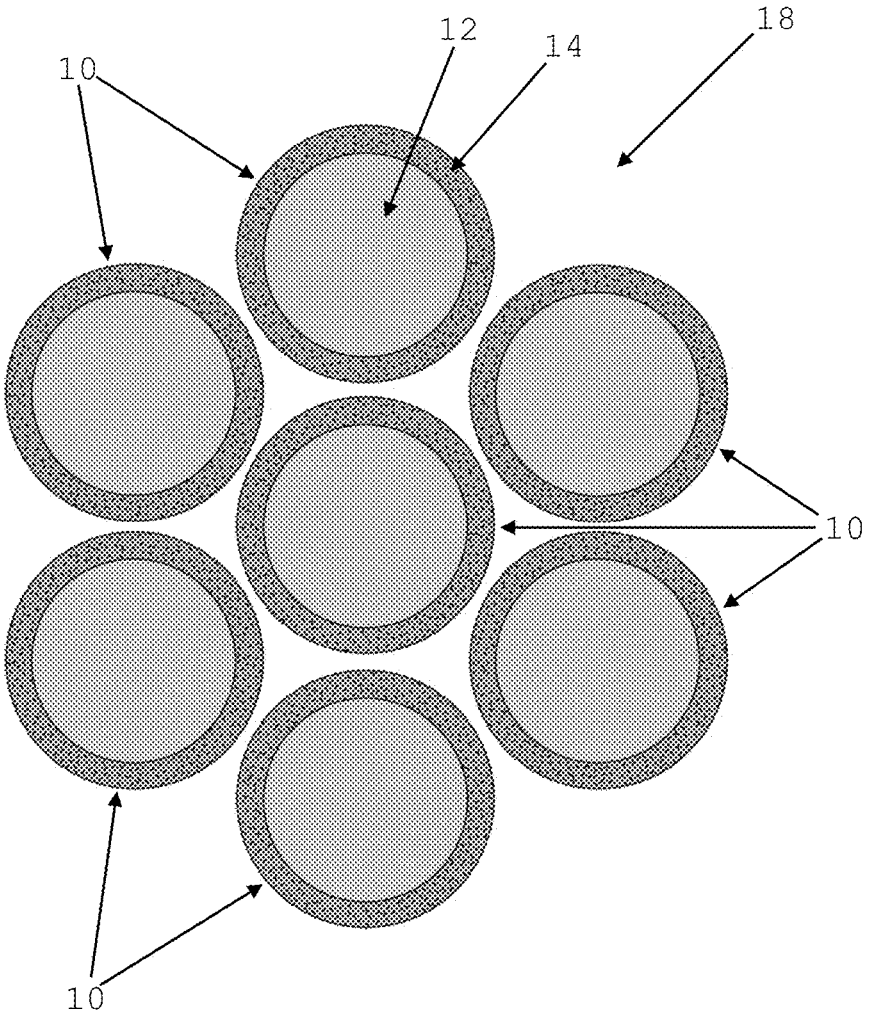
FIG. 2 shows a cross-sectional view of a bundle of thermoplastic fibers having the core/casing structure of the string core of a string (musical instrument string or sports racket string) according to one further particular embodiment of the present invention in a preliminary product stage.
Figure 3:
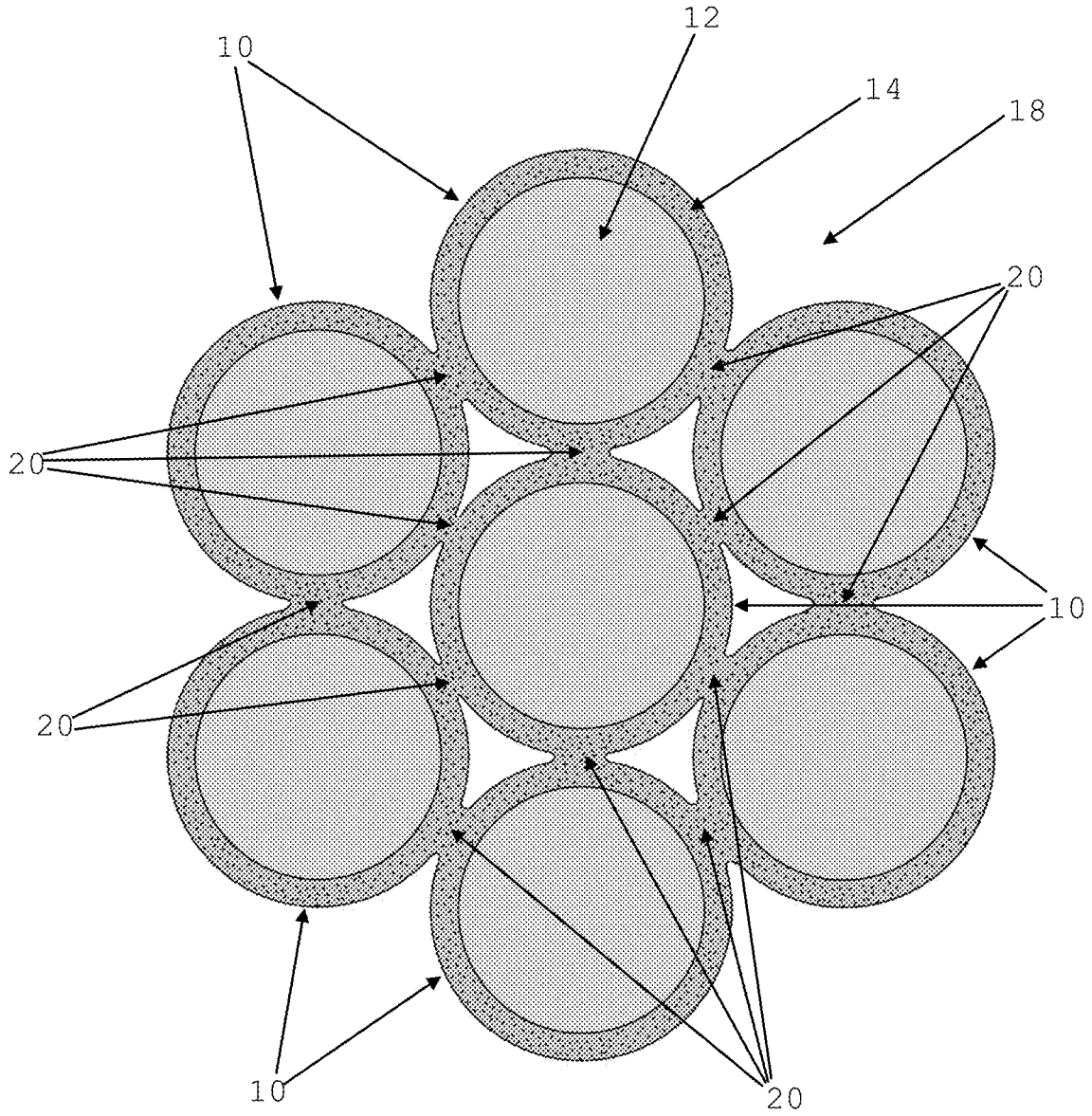
FIG. 3 shows a cross-sectional view of a bundle of thermoplastic fibers having the core/casing structure of the string core of a string (musical instrument string or sports racket string) according to one further particular embodiment of the present invention, after heating and fusing together the individual thermoplastic fibers at least partially along the boundary surfaces.

FIG. 2 shows a string core 18 which is being created and is composed of a plurality of thermoplastic fibers 10 as are shown in FIG. 1. The thermoplastic fibers 10 in the stage shown in FIG. 2 are not yet connected to one another. In FIG. 3, the thermoplastic fibers 10 shown in FIG. 2 in the longitudinal direction are at least partially fused together on the boundary surfaces 20. The fusing together can take place, for example, by running through a magnetic induction installation (not shown). On account of the ferromagnetic particles 16, the fiber casing 14 is exclusively heated when running through the induction installation and is at least partially fused as well as connected in a materially integral manner to directly neighboring thermoplastic fibers. The thermoplastic fibers form a bundle 22. On account of the fiber casing being heated exclusively, the high mechanical strength properties of the fiber core that have been achieved in the orientation process are preserved.

Figure 4:
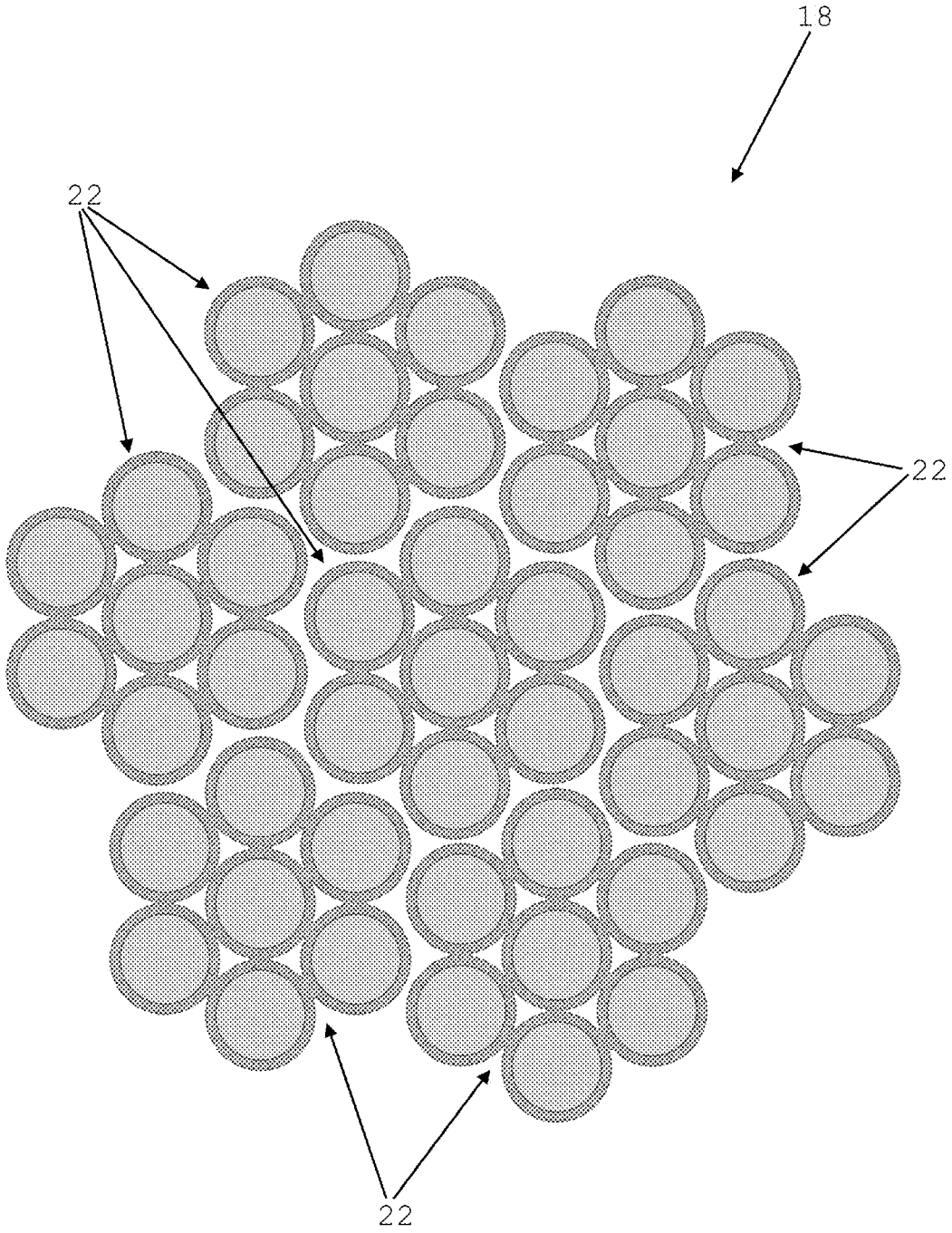
FIG. 4 shows a cross-sectional view through a plurality of bundles (a plurality of individual strands, in the present case seven) of thermoplastic fibers of FIG. 3.
Figure 5:
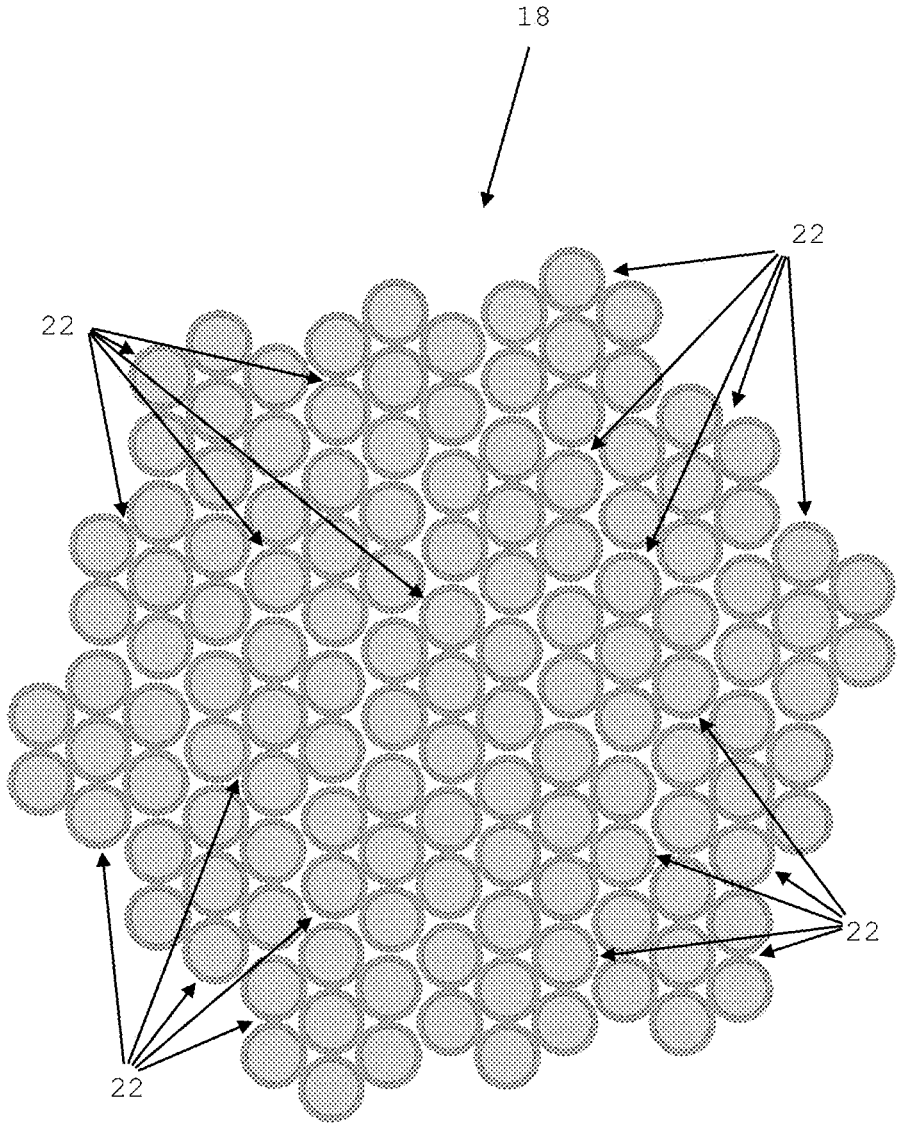
FIG. 5 shows a cross-sectional view or a plurality of bundles (a plurality of individual strands, the present case nineteen) of thermoplastic fibers of FIG. 3.

A string core 18 of a string is shown being created in FIG. 4. Said string core 18 is composed of a plurality of bundles 22 according to FIG. 3, and each bundle 22 forms an inherently bonded flexible strand. While the string core 18 in FIG. 4 is assembled from seven bundles 22, or strands, respectively, the string core 18 in FIG. 5 is even composed of nineteen bundles 22 of this type.

Figure 6:
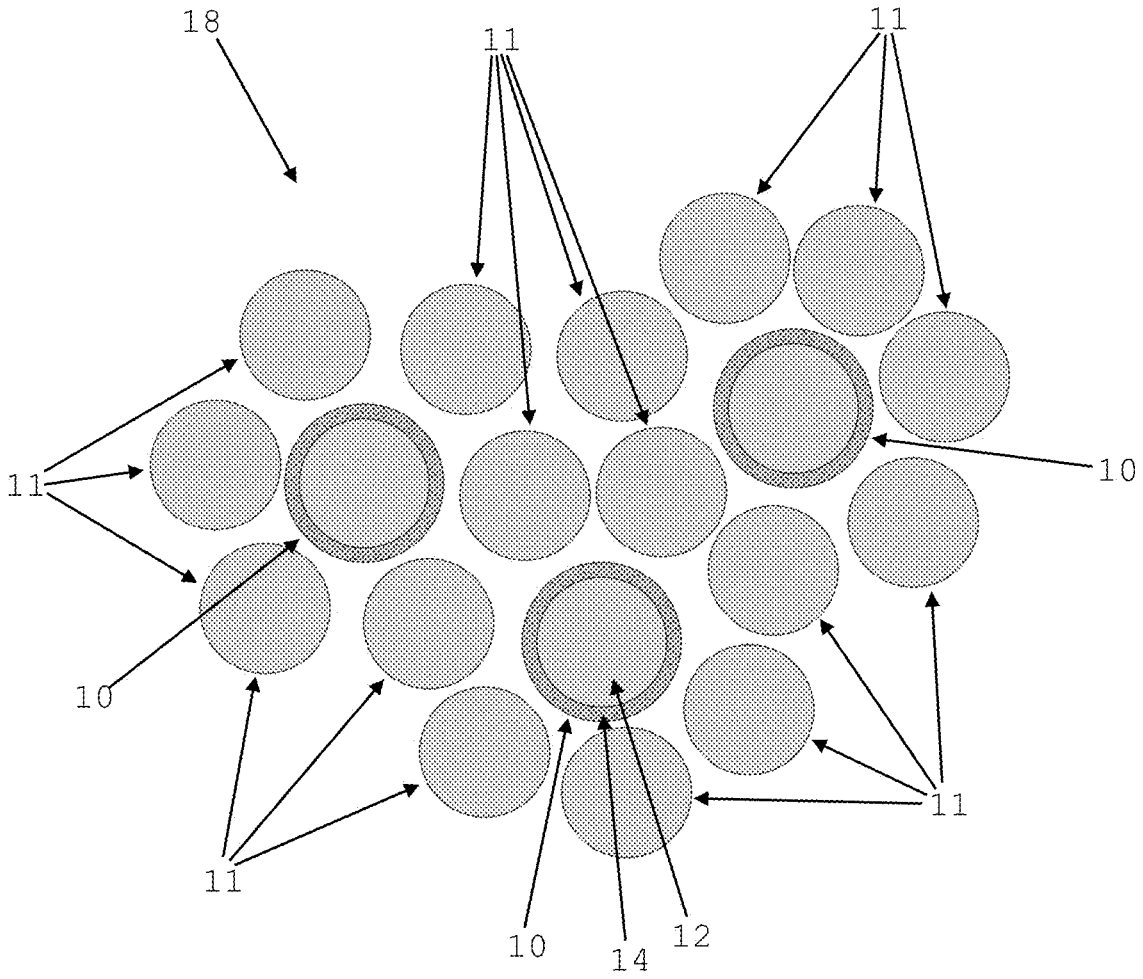
FIG. 6 shows a cross-sectional view of a multiplicity of thermoplastic fibers with and without the core/casing structure of the string core of a string (musical instrument string or sports racket string) according to one particular embodiment of the present invention in a preliminary product stage.

FIG. 6 shows a string core 18 of a string being created. Said string core 18 comprises thermoplastic fibers to having a core/casing structure as well as thermoplastic fibers 11 without said core/casing structure.

In the variant shown in FIG. 7, the string core 18 of a string comprises thermoplastic fibers to having a core/casing structure as well as thermoplastic fibers 11 without a core-casing structure and fibers 24 which are composed of a further material, for example a metal, glass, or a non-thermoplastic plastics material.

FIG. 8 finally shows a musical instrument string 26 having a string core 18, the composition thereof not being illustrated in more detail, as well as having a first sheathing 28, a second external sheathing 30 that surrounds the first sheathing 28, and an external third sheathing 32 that surrounds the second sheathing 30. The first sheathing 28 and the second sheathing 30 are in each case composed of a wrap-spun arrangement of metallic round wire or polymer monofilament, while the third sheathing 32 is composed of a wrap-spun arrangement of metallic flat wire or polymer tape.

The features of the invention that have been disclosed in the above description, in the drawings, as well is in the claims, can be relevant to the implementation of the invention in the various embodiments thereof individually as well as in the arbitrary combinations.

LIST OF REFERENCE SIGNS

10 Thermoplastic fiber
11 Thermoplastic fiber
12 Fiber core
14 Casing
16 Particles
18 String core
20 Boundary surfaces
22 Bundle
24 Fibers
26 Musical instrument string
28 First sheathing
30 Second sheathing
32 Third sheathing

The invention claimed is:

1. A string for a musical instrument or sports racket, comprising a string core, said string core further comprising a bundle of thermoplastic fibers with at least some said thermoplastic fibers of said bundle are partially-connected to one another in a materially integral manner by fusing the boundary surfaces of adjacent said thermoplastic fibers in a punctiform or linear manner wherein the elongation of said thermoplastic fibers at room temperature and at maximum tensile loading is less than 20%, and the elongation at break of said thermoplastic fibers is less than 25%.

2. The string of claim 1, further comprising said bundle of said thermoplastic fibers forms an inherently bonded flexible strand.

3. The string of claim 1, wherein said string core comprises a plurality of said bundles of said thermoplastic fibers, wherein said bundles of thermoplastic fibers form a plurality of inherently bonded flexible strands.

4. The string of claim 1 further comprising said thermoplastic fibers are highly oriented.

5. The string of claim 1 further comprising said thermoplastic fibers of said bundle are twisted in single-ply or two-ply form.

6. The string of claim 1 further comprising at least one of said thermoplastic fibers has a core/casing structure further comprised of a fiber core and a fiber casing.

7. The string of claim 6, further comprising said fiber core of said core/casing structure comprises a first thermoplastic material, and said fiber casing of said core/casing structure comprises a second thermoplastic material.

8. The string of claim 6, further comprising the volumetric proportion of said fiber casing of said core/casing structure is one of less than 60% by volume, less than 30% by volume, and less than 20% by volume.

9. The string of claim 7, further comprising said fiber casing contains solid matter particles of ferromagnetic particles or ferrimagnetic particles.

10. The string of claim 9, further comprising said solid matter particles have a primary particle diameter which is less than 500 nm.

11. The string of claim 7, further comprising said first thermoplastic material and said second thermoplastic material are identical.

12. The string of claim 1 further comprising said thermoplastic fibers comprise one of polyaryletherketone (PAEK), polyetheretherketone (PEEK), polyamide (PA), polyimide (PI), polyphenylene sulfide (PPS), and polyvinylidene fluoride (PVDF).

13. The string of claim 1 further comprising at least one sheathing disposed or wound helically about said string core and said sheathing comprises at least one plastic material or at least one metal.

14. A method for producing a string for a musical instrument or sports racket, comprising:

orienting thermoplastic fibers into a bundle such that the elongation of the thermoplastic fibers at room temperature and at maximum tensile loading is less than 20%, and the elongation at break of the thermoplastic fibers is less than 25%;

creating a string core by arranging the bundle of thermoplastic fibers;

at least partially connecting some of thermoplastic fibers to one another by fusing the boundary surfaces of adjacent thermoplastic fibers in a punctiform or linear manner by heating the bundle of thermoplastic fibers continuously or in a batch-wise manner with a magnetic induction installation.

15. The method of claim 14, wherein at least one of the thermoplastic fibers has a core/casing structure of a fiber core and a fiber casing wherein when heating the thermoplastic fibers having the core/casing structure at least the fiber casing is heated and at least slightly fused on account of the heating from the magnetic inductive installation.

16. The method of claim 15, wherein thermoplastic fibers without a core/casing structure are at least partially fused and connected in a materially integral manner to the fiber casings of surrounding thermoplastic fibers having the core/casing structure.

17. The method of claim 14, wherein heating of the thermoplastic fibers by the induction heating installation sets the tension within the thermoplastic fibers.

18. The method of claim 14, wherein the thermoplastic fibers are conjointly twisted prior to fusing.

19. The method of claim 14, wherein the string core is formed from a plurality of bundles that are arranged to form a single strand.

20. The method of claim 14 wherein the surface of the string core is sanded and/or polished by machining.

21. The method of claim 14 wherein the string core is provided with a first sheathing helically wound about the string core and the first sheathing is from one of a round wire, a flat wire, and a polymer monofilament.

22. The method of claim 21, wherein the string core is provided with at least one other sheathing that is helically wound so as to be parallel or crossed about the first sheathing and the at least one other sheathing is from one of a round wire, a flat wire, and a polymer monofilament.

* * * * *